United States Patent [19]

Colombo

[11] 4,027,724

[45] June 7, 1977

[54] ROCKING DEVICE FOR CONTINUOUS CASTING MOLDS

[76] Inventor: Piero Colombo, 27, Via Leopardi, Udine, Italy

[22] Filed: Apr. 23, 1976

[21] Appl. No.: 679,566

[30] Foreign Application Priority Data

Apr. 30, 1975 Italy ..... 12590/75

[52] U.S. Cl. ..... 164/260
[51] Int. Cl.[2] ..... B22D 11/06
[58] Field of Search ..... 164/83, 260

[56] References Cited

UNITED STATES PATENTS 2,818,616 1/1958 Rossi ..... 164/260
3,542,117 11/1970 Lemper et al. ..... 164/260 X

FOREIGN PATENTS OR APPLICATIONS 27,953 8/1971 Japan ..... 164/260

*Primary Examiner*—Robert D. Baldwin
*Attorney, Agent, or Firm*—Larson, Taylor and Hinds

[57] ABSTRACT

In a continuous casting plant for metals comprising a fixed frame, a first table fastened to said fixed frame, vertical guide means secured to said first table for supporting and guiding a second table for reciprocating movement in a vertical plane, and a mold supported by said second table, a mold rocking device comprising a motor secured to said first table, a crank keyed on the output shaft of said motor, a horizontal lever fulcrumed at an intermediate position to a frame secured to said first table, a first connecting rod articulated at one end to said crank, and at its other end to one end of said lever, and a second connecting rod articulated at one end to the second end of said lever and at its other end to a pin carried by said second table.

7 Claims, 3 Drawing Figures

ROCKING DEVICE FOR CONTINUOUS CASTING MOLDS

BACKGROUND AND SUMMARY OF THE INVENTION

This invention relates to plants for the continuous casting of metals, and more particularly to mold rocking devices for such plants.

Usually, mold rocking devices for continuous casting plants are very cumbersome and complicated.

Moreover, in known mold rocking devices, due to the complexity of the various parts of the said assemblies, it is very difficult to adjust the amplitude and/or the frequency of the oscillations imparted to the mold.

In addition to the above, in the known devices due to the excessive length of the transmission path transmitting the oscillations from the motor to the mold, elasticity and resonance phenomena take place, particularly at relatively high frequencies, in the range, for example, of 200 oscillations per minute, and more. The said phenomena make it practically impossible to assure a perfect stability of the oscillations at the said high frequencies, especially after a certain amount of wear has taken place in the joints and in the articulations of the said transmission path.

A purpose of the present invention is to obviate the above and other drawbacks of the known mold rocking devices for continuous casting plants, by providing a mold rocking device in which all the elements cooperating to provide an oscillatory motion to the mold, included therein the motor, are assembled on a fixed table, forming part of the frame of the continuous casting plant, which fixed table in turn supports and guides for reciprocating movement in a vertical plane, an oscillating table supporting the mold.

In the mold rocking device according to the invention, the motor, which may be an electrical or a fluid operated motor, drives one or more cranks transmitting the oscillatory motion to the oscillating table, through an adjustable lever transmission.

The above and other features and advantages of the present invention will be better evident from the following specification made with reference to the accompanying drawings.

DESCRIPTION OF THE PREFERRED EMBODIMENT OF THE INVENTION

Figure 1:
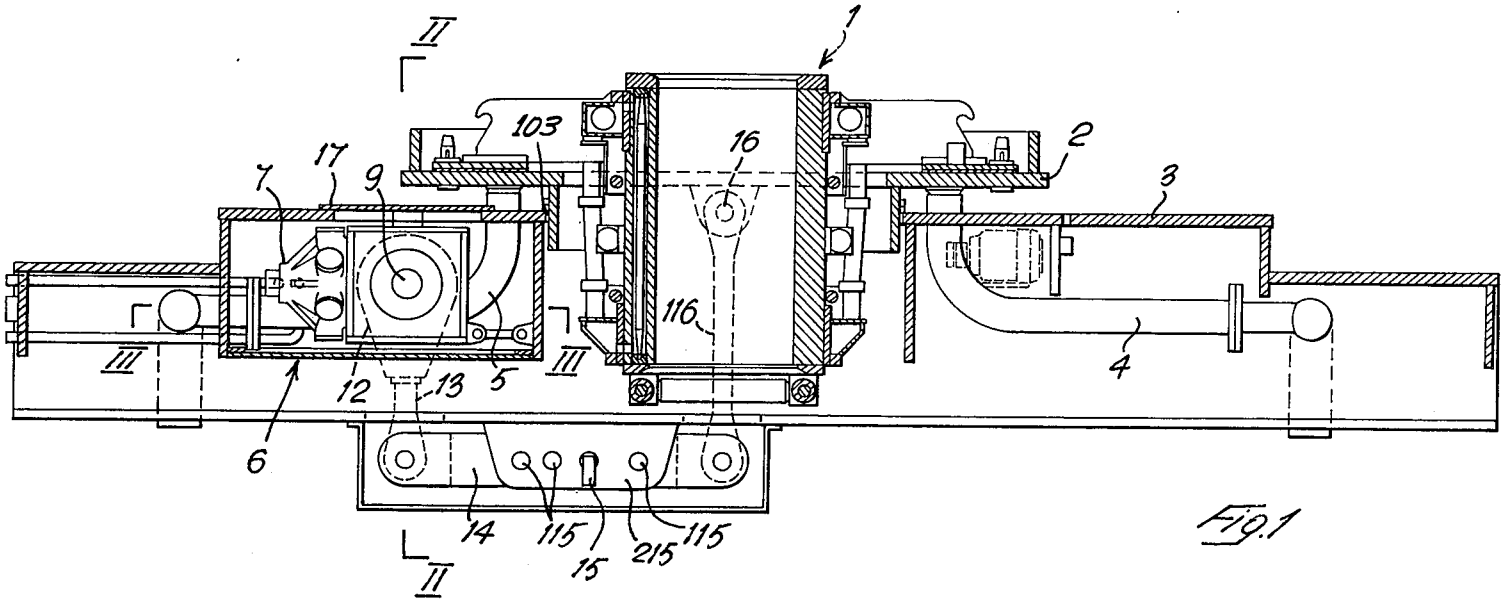
FIG. 1 is a sectional side view of a tubular mold for continuous casting plants, provided with a mold rocking device according to the invention.
Figure 2:
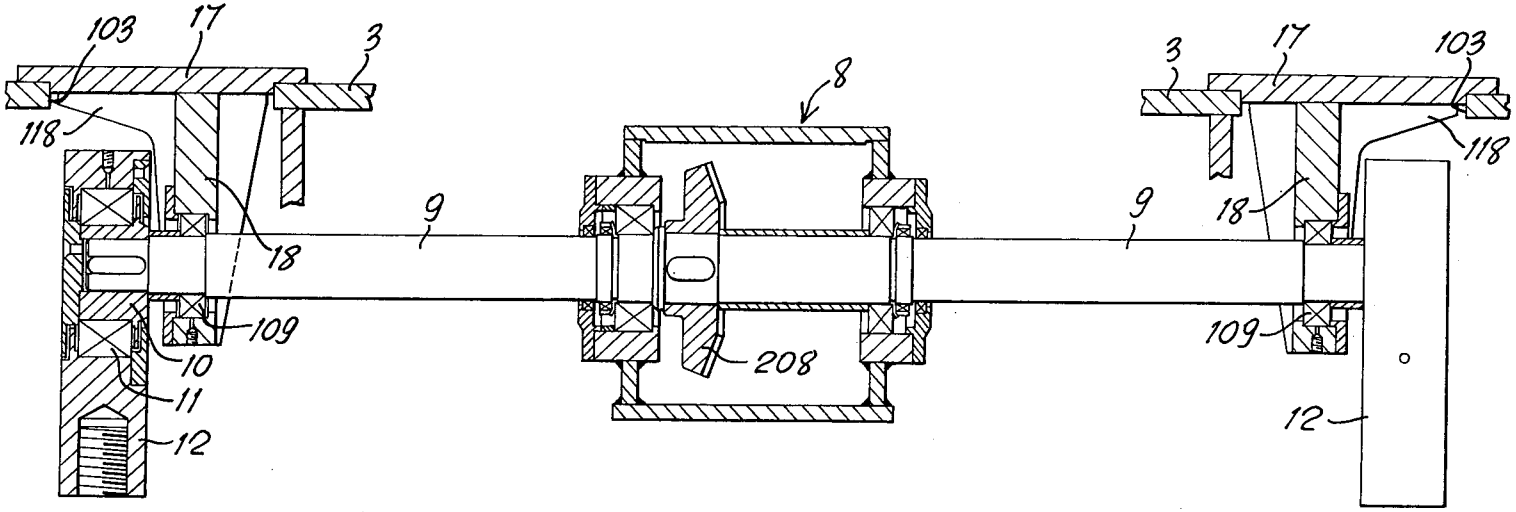
FIG. 2 is a sectional view, taken along the plane of lines II—II of FIG. 1, showing in enlarged scale, one detail of the mold rocking device of FIG. 1.
Figure 3:
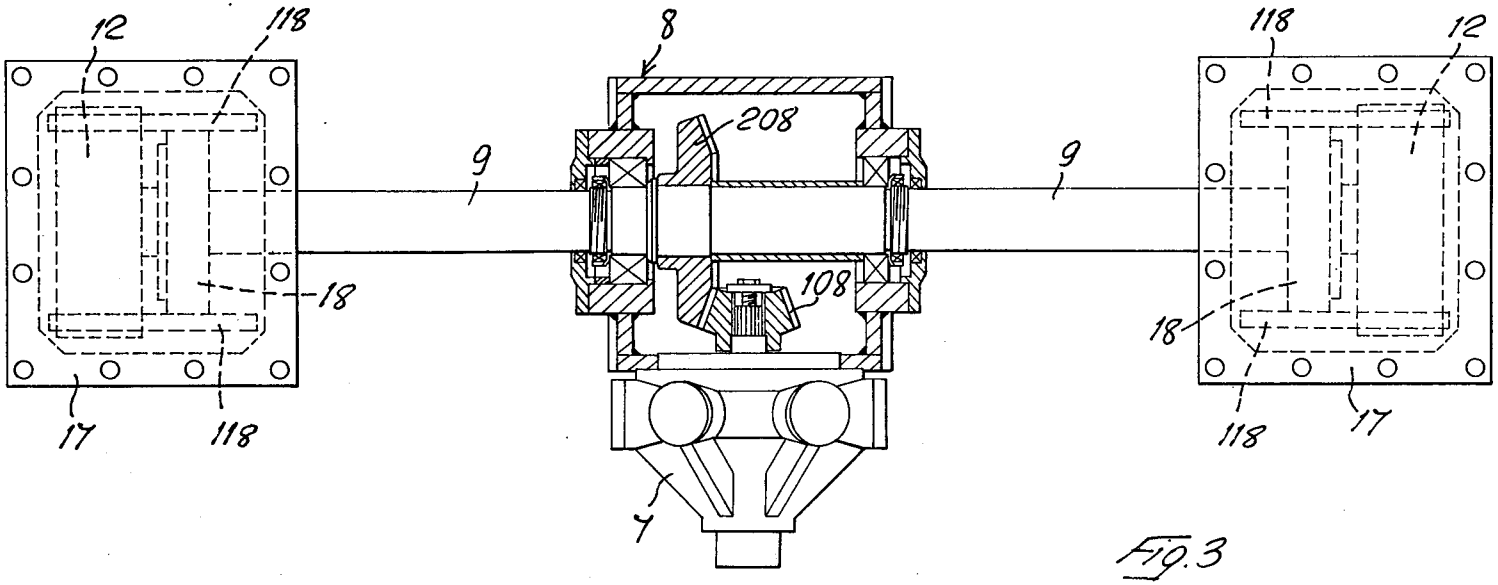
FIG. 3 is a top plan view of the detail of FIG. 1, with parts sectioned along the lines III—III of FIG. 1.

With reference to the drawings, reference number 1 generally denotes a tubular mold for continuous casting plants, which is mounted on the oscillating table 2. The table 2 is in turn supported and guided for a reciprocating movement in a vertical plane by vertical guide means 103 of a fixed table 3. Numerals 4 and 5 denote the cooling water feed pipes, feeding cooling water to the mold 1. According to the invention, the mold rocking device is assembled on the fixed table 3. The said mold rocking device, which is generally indicated by the reference 6, comprises a driving motor 7, which may be a fluid operated motor or an electric motor, the output shaft of which drives, through the intermeshing conical gears 108 and 208, housed in the gear box 8, the shaft 9. To each end of shaft 9 a cam 10 is keyed, the said cams 10 being in operative engagement with the collars 12, through the interposition of the bearings 11. Secured to each collar is one end of a rod 13, the other end of which is articulated, through a suitable pin, to one end of a lever 14. The levers 14 are fulcrumed by means of pins 15, to a bracket 215 secured to the fixed table 3. The brackets 215 are provided with a plurality of aligned bores 115, a plurality of corresponding bores being also formed in the lever 14. The lever 14 is articulated at its other end, by means of a suitable pin, to one end of a connecting rod 116, the other end of which is articulated to the pin 16, which is in turn secured to the oscillating table 2.

OPERATION OF THE DESCRIBED EMBODIMENT

Whenever the motor 7 is put into operation, it drives, through the gear train 108, 208 the shaft 9. The rotation of shaft 9 causes the rotation of cams 10, thus imparting to the collars 12 a reciprocating movement. The reciprocating movement of collars 12 is transmitted through rods 13, to the lever 14, and from this lever 14, through connecting rods 116, to the oscillating table 2, thus imparting a reciprocating motion to the mold 1 which is supported by table 2.

By adjusting the position of the pin 15, it is possible to vary the frequency and amplitude of the oscillations transmitted to table 2.

The entire assembly 6 of the mold rocking device is fastened in a dismountable manner to the table 3 by means of the supports 18 housing the bearings 109 for the shaft 9, and by means of the fastening plates 17, provided with reinforcing brackets 118.

In this manner, the entire assembly 6 is independent from the other elements of the casting plant, and may be easily disassembled from the casting plant as a whole.

I claim:

1. A continuous casting plant for metals comprising:

a fixed frame, a first table fastened to said fixed frame and a motor secured to said first table, a vertical guide means secured to said first table for supporting and guiding a second table for vertical reciprocating movement, a mold supported by the second table for vertical reciprocating movement along with the second table, at least a portion of the mold being located at the same level as the said motor, a first connecting rod operatively connected to the output shaft of the motor and extending downwardly therefrom to reciprocate vertically, a second connecting rod articulated at one end to the second table and extending downwardly therefrom, and a lever extending horizontally at a level below the level of the motor and of the mold, said lever fulcrumed at an intermediate position to a frame secured to the first table, and the opposite ends of said lever connected respectively to the lower ends of the first and second connecting rods, whereby the motor, acting downwardly through the first connecting rods and across the lever and upwardly along the second connecting rods effects vertical reciprocating movement of the second table and hence also of the mold.

2. A mold rocking device according to claim 1, in which said motor is a fluid operated motor.

3. A mold rocking device according to claim 1 in which said motor is an electrically operated motor.

4. A mold rocking device according to claim 1 in which the said motor is a variable speed motor.

5. A mold rocking device according to claim 1, in which the output shaft of the motor is connected to the input of a speed change gear.

6. The invention according to claim 1, comprising a first conical gear keyed on the output shaft of the motor, a second conical gear keyed on a transmission shaft lying at right angles with respect to the motor output shaft, said first and second conical gears being in mesh with one another, bearing means carried by said table for supporting the said transmission shaft, crank means keyed on both ends of said transmission shaft, a pair of said horizontally extending levers, both located beneath the level of the mold and table and each fulcrumed at an intermediate position to said frame carried by the first table, a pair of said first connecting rods, one articulated at its upper end to each of said crank means, and each connected at its lower end to one of said levers, and a pair of said second connecting rods, one articulated at its lower end to each of said levers, and each of said second connecting rods connected at their upper ends to a pin secured to the second table.

7. A mold rocking device according to claim 6, in which the said horizontal levers are provided with a set of aligned borings, a corresponding, set of aligned borings being provided in the said levers supporting frames, pin means being provided for insertion through said bores in said frames and in said levers so as to adjust the fulcrum of said levers.

* * * * *